United States Patent [19]

Grilliot et al.

[11] Patent Number: 5,036,548

[45] Date of Patent: Aug. 6, 1991

[54] FIREFIGHTER'S COMBINATION TROUSERS AND SAFETY HARNESS

[76] Inventors: William L. Grilliot; Mary I. Grilliot, both of 1986 Home Ave., Dayton, Ohio 45417

[21] Appl. No.: 487,378

[22] Filed: Mar. 2, 1990

[51] Int. Cl.[5] ..... A41D 13/00

[52] U.S. Cl. ..... 2/81; 2/79; 2/227; 182/3

[58] Field of Search ..... 2/79, 81, 227, 229, 2/235; 182/3; 248/925

[56] References Cited

U.S. PATENT DOCUMENTS

| | | | |
|---|---|---|---|
| 2,979,153 | 4/1961 | Hoagland | 2/81 |
| 3,176,793 | 4/1965 | Hlacia | 182/3 |
| 4,302,847 | 12/1981 | Miles | 2/227 |
| 4,632,217 | 12/1986 | Markwell | 182/3 |
| 4,687,074 | 8/1987 | Green | 182/3 |
| 4,731,882 | 3/1988 | Ekman | 2/79 |
| 4,817,210 | 4/1989 | Aldridge | 2/81 |

FOREIGN PATENT DOCUMENTS

| | | | |
|---|---|---|---|
| 2529559 | 1/1978 | Fed. Rep. of Germany | 182/3 |
| 2292492 | 6/1976 | France | 182/3 |

OTHER PUBLICATIONS

Atlas Safety Equipment Co., Inc. Catalogue, p. 8.
PMI Catalog Page, published in 1988.

*Primary Examiner*—Werner H. Schroeder
*Assistant Examiner*—Diana L. Biefeld
*Attorney, Agent, or Firm*—Jacox & Meckstroth

[57] ABSTRACT

A firefighter's trousers and a safety harness combination garment. Preferably, the safety harness has connection parts which are connectable to secure the safety harness and the firefighter's trousers as a unit upon the firefighter who wears the garment.

18 Claims, 3 Drawing Sheets

FIREFIGHTER'S COMBINATION TROUSERS AND SAFETY HARNESS

BACKGROUND OF THE INVENTION

In many large cities the duties of a firefighter include firefighting in the upper floors of a skyscraper type of building. In many situations, a firefighter is required to wear a safety harness and carry rope which is capable of extending over several floors. In this manner, if a firefighter is trapped above a fire floor and the fire may advance upwardly, the firefighter can use the safety harness and the rope to lower himself/herself outside the building to a safe location.

A problem exists as the firefighter wears such a safety harness. The bulk of the firefighter's garments plus the bulk of the safety harness is considered objectionable. Furthermore, the safety harness positioned upon the garments is subjected to high heat conditions as the firefighter fights a fire. The safety harness therefore may be damaged as the firefighting occurs.

Also, when a firefighter expects to fight a fire in the upper stories of a skyscraper type of building the firefighter must don a safety harness, in addition to donning firefighting protective clothing. Therefore, additional time is required to prepare for high level firefighting conditions.

It is an object of this invention to provide in combination, a firefighter's protective trousers and a safety harness.

It is another object of this invention to provide such a combination in which the firefighter's trousers and the safety harness are donned together, as a unit.

It is another object of this invention to provide such a combination of a firefighter's protective trousers and safety harness in which the safety harness is protected by the firefighter's trousers.

It is another object of this invention to provide such a combination of a firefighter's protective trousers and safety harness in which the trousers and the safety harness are secured to the firefighter by the same attachment means.

Other objects and advantages of this invention reside in the construction of parts, the combination thereof, the method of production, the method of assembly, and the mode of use, as will become more apparent from the following description.

SUMMARY OF THE INVENTION

This invention comprises, in combination, a firefighter's protective trousers and a safety harness. The safety harness is carried by the firefighter's protective trousers and includes a support element which is exterior of the trousers. Preferably, the safety harness has attachment portions and the trousers have attachment portions, all of which are attached together in substantially the same operation. Thus, the trousers and the safety harness are donned together and secured together as a unit. Therefore, the time involved in donning the trousers and the safety harness is minimal.

DETAILED DESCRIPTION OF THE PREFERRED EMBODIMENT

Trousers 10 of this invention comprise an outer shell 12 and an inner liner 14. The outer shell 12 is of abrasion resistant and flame resistant material. The inner liner 14 may comprise one or more layers and is of thermal protective material and moisture protective material. The outer shell 12 has leg portions 12*a* and 12*b*. The inner liner 14 has leg portions 14*a* and 14*b*.

Figure 2:
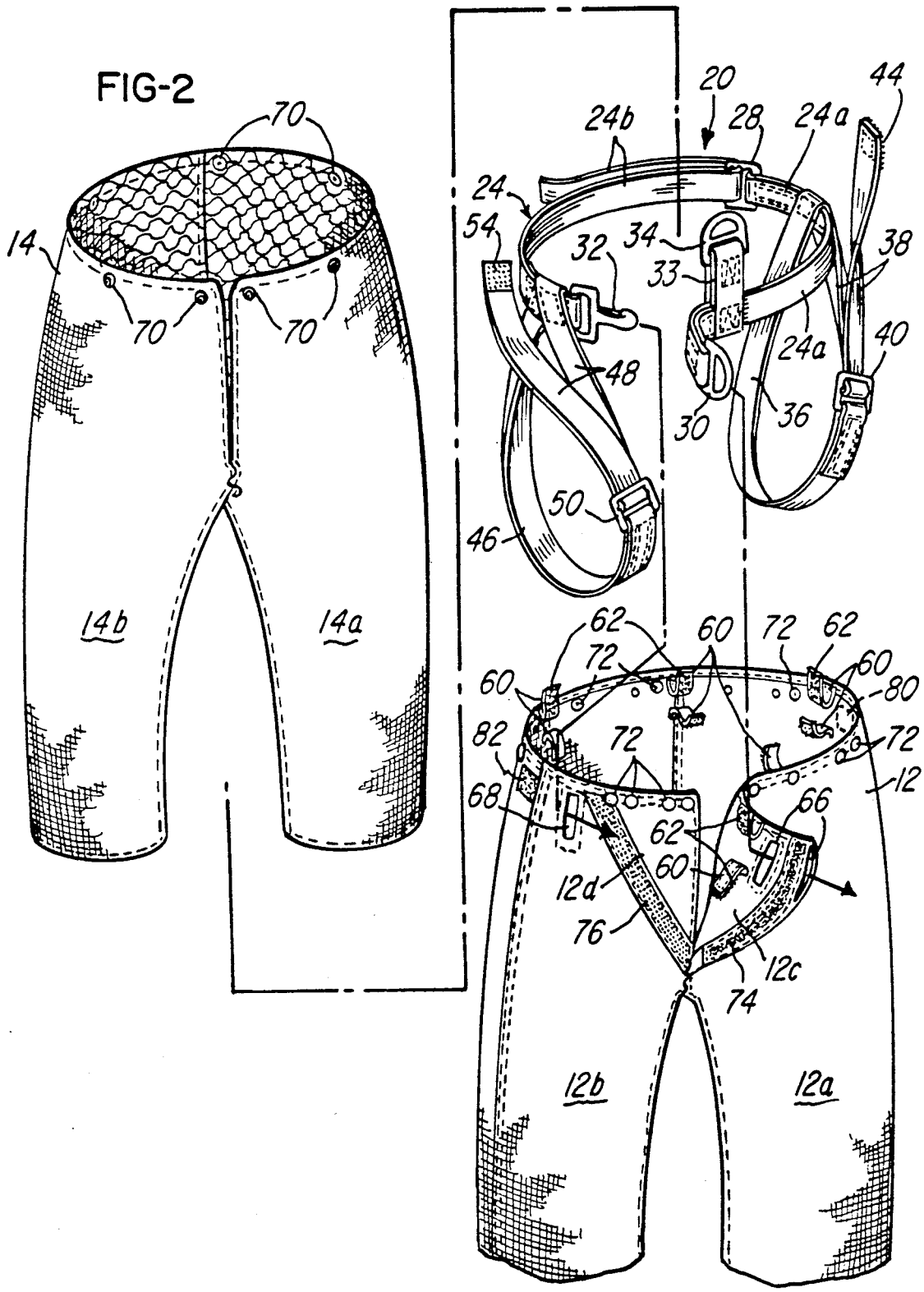
FIG. 2 is an exploded perspective view, drawn on a larger scale than FIG. 1, illustrating the assembly of a firefighter's trousers and safety harness combination unit.

A safety harness 20 of this invention is best shown in FIG. 2. The safety harness 20 comprises a belt 24, which includes a belt section 24*a* and a belt section 24*b*. The belt sections 24*a* and 24*b* are joined together by a slide fastener 28, which provides means for adjustment of the belt sections 24*a* and 24*b*, one with respect to the other. Attached to the end of the belt section 24*a* is an annular connector member 30. Attached to the end of the belt section 24*b* is a snap connector 32.

Attached to the belt section 24*a* adjacent the annular connector member 30 is a short strap 33. Secured to the end of the short strap 33 is an annular support connector member 34.

Attached to the belt section 24*a* intermediate the ends thereof, and extending downwardly therefrom, is a support strap 36. Also attached to the belt section 24*a* intermediate the ends thereof and extending downwardly therefrom is a support strap 38. It is to be understood that the support straps 36 and 38 may comprise a single strap. A slide fastener 40 connects the support strap 36 to the support strap 38. Thus, the support straps 36 and 38, and the slide fastener 40 form a support loop. At the end of the support strap 38 is a hook and pile element 44.

Attached to the belt section 24*b* and extending downwardly therefrom is a support strap 46. Also, attached to the belt section 24b and extending downwardly therefrom is a support strap 48. It is to be understood that the support straps 46 and 48 may comprise a single strap. A slide fastener 50 connects the support strap 46 to the support strap 48. Thus, the support straps 46 and 48, and the slide fastener 50 form a support loop. At the end of the support strap 48 is a hook and pile element 54.

Figure 1:
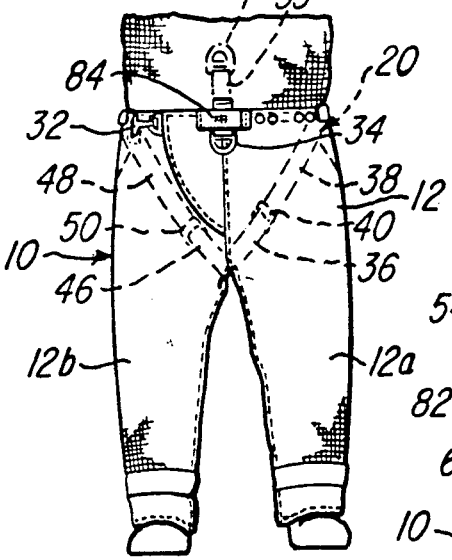
FIG. 1 is a front elevational view showing a firefighter's trousers and safety harness combination unit of this invention.
Figure 4:
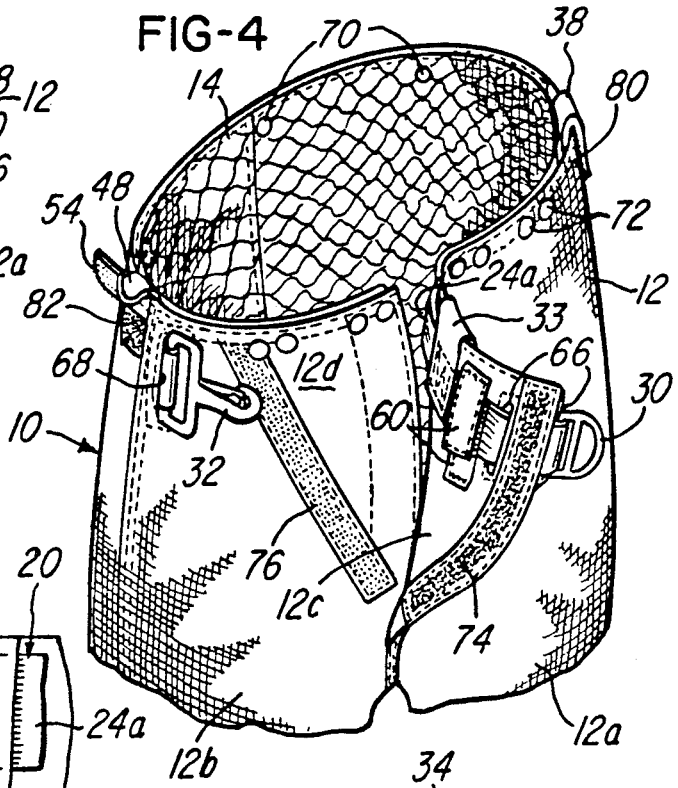
FIG. 4 is a fragmentary front perspective view, drawn on substantially the same scale as FIG. 3, showing a portion of the firefighter's trousers and safety harness unit after assembly of the safety harness within the firefighter's trousers.
Figure 3:
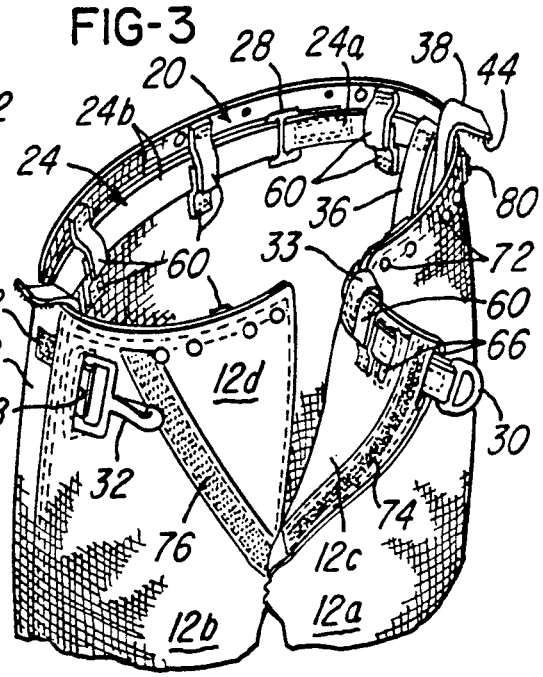
FIG. 3 is a fragmentary front perspective view, drawn on substantially the same scale as FIG. 2, illustrating attachment of the safety harness within the shell of the firefighter's trousers.

Within the shell 12, at the upper part thereof, are pairs of tabs 60, as best shown in FIG. 2. Each tab 60 has an end portion secured to the shell 12. Each tab 60 also has an opposite end portion to which is secured a hook and pile member 62. The belt sections 24a and 24b are positioned between each of the pairs of tabs 60, and each of the pairs of tabs 60 is attached together by the hook and pile member 62, as shown in FIG. 3. The shell 12 has a flap 12c which has an opening 66 therethrough. The shell 12 has a flap 12d which has an opening 68 therethrough. The belt section 24b extends through the opening 68 in the flap 12d. Thus, the snap connector 32 is exterior of the shell 12. The belt section 24a extends through the opening 66 in the flap 12c. Thus, the connector member 30 is exterior of the shell 12, as shown in FIG. 4. Thus, the shell 12 carries the belt sections 24a and 24b, and the support straps 36, 38, 46, and 48 extend downwardly from the belt sections 24a and 24b, as the support straps 36, 38, 46, and 48 are within the shell 12.

After the safety harness 20 is so attached to the shell 12 and positionable therewithin, the inner liner 14 is positioned within the shell 12. The leg portions 14a and 14b, of the inner liner 14 are positioned within the leg portions 12a and 12b of the outer shell 12. As the inner liner 14 is positioned within the shell 12, the leg portion 14a is moved through the support loop which comprises the support straps 36 and 38, and the leg portion 14b of the inner liner 14 is moved through the support loop which comprises the support straps 46 and 48.

Then the inner liner 14 is attached to the shell 12 in any suitable manner. Herein the inner liner 14 is provided with button snap connectors 70 which are attached to complementary button snap connectors 72 within the shell 12. Thus, the shell 12, and the safety harness 20 and the inner liner 14 become an apparel unit for donning and for wear by a firefighter.

Figure 7:
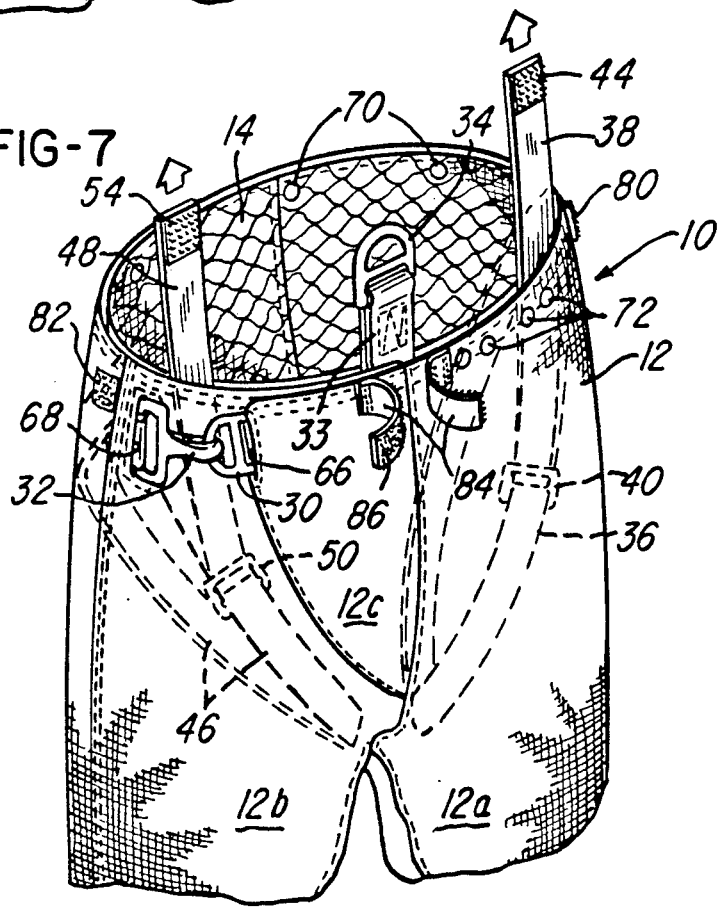
FIG. 7 is a fragmentary front perspective view, drawn on substantially the same scale as FIG. 4, showing a portion of the firefighter's trousers and safety harness unit as the safety harness is prepared for use in supporting a firefighter who wears the trousers.

The flaps 12c and 12d of the shell include hook and pile strips 74 and 76, respectively. Thus, as a firefighter dons the trousers 10 and the safety harness 20 as a unit, the firefighter's legs are within the leg portions 12a and 12b of the outer shell 12 and extend through the leg portions 14a and 14b of the inner liner 14. The firefighter's legs also extend through the support loops formed by the support straps 36, 38, 46, and 48. As the trousers 10 and safety harness 20 are donned, the flap 12c is positioned upon the flap 12d of the shell 12, and the hook and pile strips 74 and 76 are attached together, as illustrated in FIG. 7. Then the snap connector 32 of the belt section 24b is attached to the annular connector member 30. Thus, the firefighter's trousers 10 and safety harness 20 are secured upon the firefighter in the single operation of attaching the snap connector 32 to the annular connector member 30. Thus, the firefighter's trousers 10 and the safety harness 20 are donned as a unit.

Figure 8:
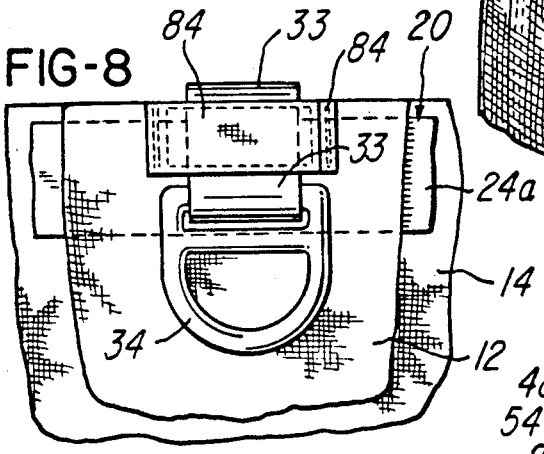
FIG. 8 is a fragmentary front view, drawn on a larger scale than the other figures, showing the safety harness support connection member in an inactive position.
Figure 5:
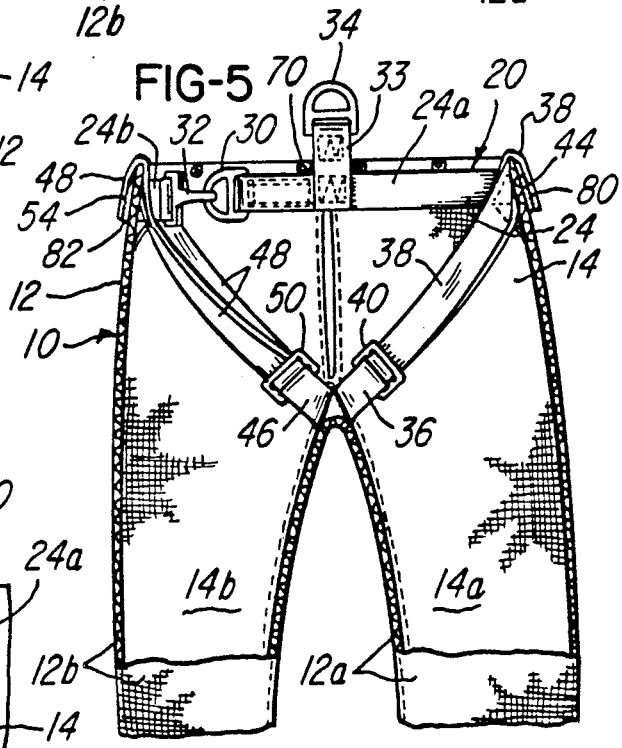
FIG. 5 is a fragmentary front view, with parts broken away and shown in section and drawn on a slightly smaller scale than FIG. 4, illustrating the firefighter's trousers and safety harness unit.
Figure 6:
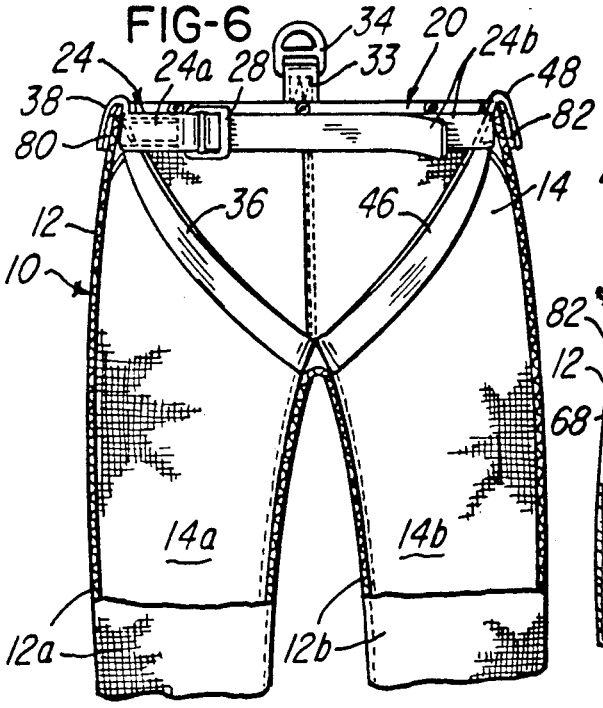
FIG. 6 is a fragmentary rear view, drawn on substantially the same scale as FIG. 5, with parts broken away and shown in section, illustrating the firefighter's trousers and safety harness unit.

In normal firefighting use of the trousers 10 and safety harness 20, the hook and pile element 44 at the end of the support strap 38 is attached to a complementary hook and pile element 80 which is on the exterior of the shell 12 at the upper part thereof. Also, the hook and pile element 54 at the end of the support strap 48 is attached to a hook and pile element 82 on the exterior of the shell 12 at the upper part thereof, as shown in FIGS. 5 and 6. Also, the short strap 33 hangs over the upper part of the shell 12 adjacent the front central part thereof and is retained in position by a pair of tabs 84 which are provided with complementary hook and pile attachment elements 86, as shown in FIG. 8.

Thus, as the firefighter wears the trousers 10 and the safety harness 20 as a unit the firefighter is prepared for firefighting activity in the upper floors of a skyscraper type of building or the like. Due to the fact that the safety harness 20 is within the trousers 10 and protected by the trousers 10, the safety harness 20 may be of lighter weight material than a conventional harness. Thus, the stress upon the firefighter is lessened. As stated and as shown, the only significant portion of the safety harness which is exterior of the trousers 10 is the short strap 33 and support connector member 34. Therefore, there are no hanging straps or the like exterior of the trousers 10 to become entangled in other elements as the firefighter is engaged in firefighting.

Figure 9:
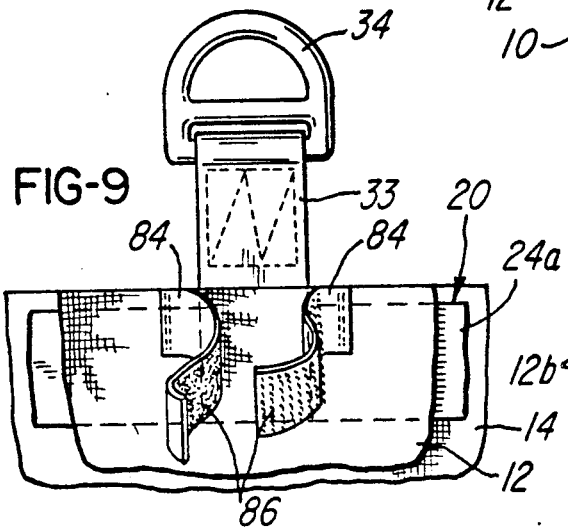
FIG. 9 is a fragmentary front view, similar to FIG. 8 and drawn on substantially the same scale as FIG. 8, showing the safety harness support connection member in an active position.

If a situation should occur in which the firefighter must descend outside the building, the firefighter detaches the end portions of the support straps 38 and 48 from the upper exterior part of the shell 12, from the positions thereof shown in FIGS. 5 and 6. Then the firefighter pulls the end portions of the support straps 38 and 48 upwardly, as illustrated in FIG. 7. As the firefighter pulls the support straps 38 and 48 upwardly, the support straps 38 and 48 slidably move within the slide fasteners 40 and 50, respectively. Thus, there is relative movement between the support strap 38 and the support strap 36, and there is relative movement between the support strap 48 and the support strap 46. Thus, the support loops formed by the support straps 36, 38, 46, and 48 become smaller, and the support loops formed by the support straps 36, 38, 46 and 48 come into firm supporting relationship with the leg portions 14aand 14b of the inner liner 14 at the upper leg portions of the firefighter. Then the firefighter releases the short strap 33 from the tabs 84 and moves the short strap 33 and the support connector member 34 from the positions thereof shown in FIG. 8 to the positions thereof shown in FIG. 9. Then the firefighter passes a support rope through the support connector member 34. Then as the support rope is firmly attached to an element or structure within the building, the firefighter, supported by the rope lowers himself or herself outside the building to a safe location.

A garment of this invention may comprise a combination in which a safety harness is attached to a firefighter's trousers, as a unit, with the safety harness exterior of the trousers.

Therefore, it is understood that a garment of this invention which comprises the firefighter's trousers 10 and safety harness 20 comprises a unit which is much more desirable than the conventional safety harness and firefighter's trousers which are separately donned by a firefighter.

Although the preferred embodiment of the firefighter's combination trousers and safety harness of this invention has been described, it will be understood that within the purview of this invention various changes may be made in the form, details, proportion and arrangement of parts, the combination thereof, the method of construction and the method of use, which generally stated consist in a structure and a method within the scope of the appended claims.

The invention having thus been described, the following is claimed.

1. In combination, a firefighter's trousers and safety harness in which the firefighter's trousers include an outer shell and an inner liner, the safety harness including a belt provided with a pair of opposed end portions, complementary connector means carried by the end portions and attachable together, the shell having an upper internal region, the upper internal region of the outer shell including support means for supporting the belt within the outer shell, the outer shell having an upper exterior region, the outer shell also having openings through which the end portions of the belt extend, whereby the complementary connector means are positioned adjacent the upper exterior region of the shell, the safety harness also including a pair of support loop portions which are attached to the belt and which extend downwardly from the belt, the inner liner being positioned within the outer shell and attached thereto, the inner liner having leg portions which extend through the support loop portions of the safety harness, a support strap attached to the belt and extending therefrom, and a support connector member attached to the support strap, the support connector member being adapted to receive a support rope which supports a firefighter who wears the firefighter's trousers.

2. The combination of claim 1 in which the shell of the firefighter's trousers includes a pair of flap portions, at least one of the openings in the shell being within each of the flap portions, the flap portions being positionable together to secure the shell upon the firefighter who wears the firefighter's trousers, whereby the complementary connector means are attachable together to secure both the belt and the flap portions of the shell in desired positions upon the firefighter who wears the trousers.

3. The combination of claim 1 in which the support loop portions of the safety harness include means for adjusting the size of the support loop portions for adjusting the support loop portions for firm contact with parts of the inner liner which engage the upper leg portions of the firefighter who wears the trousers.

4. The combination of claim 1 in which each of the support loop portions of the safety harness includes slide connection means through which parts of the support loop portions extend, whereby the size of the loops formed by the support loop portions can be adjusted.

5. A method of producing a firefighter's garment comprising providing outer shell material having flame resistant and abrasion resistant qualities, forming the outer shell material into the form of a pair of trousers, providing inner liner material having thermal resistant and moisture resistant qualities, forming the inner liner material into the form of a pair of trousers, providing a belt, providing a pair of body support loops, attaching the pair of body support loops to the belt to form a safety harness, attaching the belt to at least one of the pairs of trousers, inserting the pair of trousers which is formed by the inner liner material into the pair of trousers which is formed by the outer shell material, extending portions of at least one of the pairs of trousers through the support loops, and attaching the pair of trousers which is formed by the inner liner material to the pair of trousers which is formed by the outer shell material, whereby the pairs of trousers and the belt and the support loops form a firefighter's garment.

6. The method of claim 10 which includes forming connection sections in the pair of trousers which is formed by the outer shell, whereby connection together of the connection sections secures the pair of trousers upon the firefighter who wears the trousers, forming a pair of openings through the connection sections, forming portions of the belt into attachment portions whereby attachment of the attachment portions together secures the belt upon the firefighter who wears the garment, extending the attachment portions of the belt through the openings in the connection sections, whereby the attachment portions of the belt can be attached together exterior of the pair of trousers which are formed by the outer shell material, and whereby the belt can be secured upon the firefighter and the trousers secured upon the firefighter by attachment together of the attachment portions of the belt.

7. The method of claim 10 which includes extending portions of the pair of trousers which is formed by the inner liner through the body support loops.

8. The method of claim 5 which includes forming a pair of attachment sections in the pair of trousers which is formed by the outer shell material, whereby the attachment sections are attachable together to secure the trousers to the firefighter who wears the garment, forming a pair of connection portions in the belt, attaching a portion of the belt to each of the attachment sections of the pair of trousers which is formed by the outer shell material, whereby said connection portions of the belt are attachable together to secure the trousers upon the firefighter who wears the garment and whereby said connection portions of the belt are attachable together to secure the safety harness upon the firefighter, whereby attachment of the connection portions of the belt together simultaneously secures the trousers and the safety harness upon the firefighter who wears the garment.

9. The method of claim 5 which includes providing the support loops with means for adjustment of the size of the support loops.

10. A firefighter's trousers comprising an outer shell of flame resistant and abrasion resistant material, inner liner material within the outer shell and including thermal protective material and moisture protective material, a safety harness, the outer shell including means for support of the safety harness, the safety harness including support means positioned within the outer shell for support of the firefighter who wears the firefighter's trousers, the outer shell including an internal region, support means carried by the internal region of the outer shell for support of the safety harness, connection means for attaching the inner liner material to the outer shell as the support means of the safety harness is positioned between the outer shell and the inner liner material.

11. In combination, a firefighter's trousers and safety harness in which the firefighter's trousers include an outer layer and an inner layer, a plurality of complementary connector members means joining the complementary connector members to the safety harness, the complementary connector members being attachable together to secure the safety harness upon the firefighter who wears the trousers and safety harness combination, at least one of the layers including a support region which supports the safety harness, the outer layer including closure means for securing the outer layer upon the firefighter, means joining the complementary connector members to the closure means of the outer layer, whereby the complementary connector members are attachable together to secure the outer layer upon the firefighter while simultaneously securing the safety harness upon the firefighter, the safety harness including a support loop portion, at least one of the layers having a part positioned within the support loop portion of the safety harness, the safety harness including a support member which is adapted to receive a support rope which supports a firefighter who wears the firefighter's trousers and safety harness combination.

12. A method of producing a firefighter's garment comprising providing outer shell material having flame resistant and abrasion resistant qualities, forming the outer shell material into the form of a pair of trousers, providing inner liner material having thermal barrier qualities and moisture barrier qualities, forming the inner liner material into the form of a pair of trousers, positioning the pair of trousers which is of the inner liner material into the pair of trousers which is of the outer shell material, attaching together the pair of trousers which is of the inner liner material and the pair of trousers which is of the outer shell material, providing a safety harness, and attaching the safety harness to at least one of the pairs of trousers, whereby the pairs of trousers and the safety harness form a unit, the safety harness including a pair of support loops and in which the method includes positioning the support loops between the pair of trousers, which is of the inner liner material and the pair of trousers which is of the outer shell material.

13. A firefighter's garment comprising a pair of firefighter's trousers which includes an outer shell structure of abrasion resistant and flame resistant material and inner liner structure of thermal resistant and moisture resistant material, a safety harness, and attachment means for attaching the firefighter's trousers and the safety harness together as a unit, the pair of firefighter's trousers having an internal portion, the attachment means including means carried by the internal portion of the firefighter's trousers for attaching the safety harness to the pair of firefighter's trousers.

14. A firefighter's garment comprising a pair of firefighter's trousers which includes an outer shell structure of abrasion resistant and flame resistant material and inner liner structure of thermal resistant and moisture resistant material, a safety harness, and attachment means for attaching the firefighter's trousers and the safety harness together as a unit, the pair of firefighter's trousers also including a main portion and a connection portion, the connection portion being positionable at a desired position with respect to the main portion to secure the pair of firefighter's trousers upon the firefighter who wears the garment, the safety harness including an extension part which is movable into engagement with the connection portion of the pair of firefighter's trousers to maintain the desired position of the connection portion, securing means attached to the extension part of the safety harness and operable to secure the position of the safety harness upon the firefighter and to maintain the extension part of the safety harness in engagement with the connection portion of the pair of firefighter's trousers to maintain the desired position of the connection portion, whereby operation of the securing means simultaneously secures the position of the pair of firefighter's trousers upon the firefighter and secures the position of the safety harness upon the firefighter who wears the garment.

15. In combination, a firefighter's trousers and safety harness in which the firefighter's trousers including an outer layer and an inner layer of firefighting protective material, a plurality of complementary connector members, means joining the complementary connector members to the safety harness, the complementary connector members being attachable together to secure the safety harness upon the firefighter who wears the trousers and safety harness combination, at least one of the layer including a support region which supports the safety harness, one of the layers including closure means for securing the trousers upon the firefighter, means joining the complementary connector members to the closure means, whereby the complementary connector members are attachable together to secure the trousers upon the firefighter while simultaneously securing the safety harness upon the firefighter.

16. A pair of firefighter's trousers comprising a first portion and a movable enclosure portion, the movable enclosure portion being positionable in a desired position with respect to the first portion of the pair of firefighter's trousers to maintain the pair of firefighter's trousers upon the firefighter who wears the firefighter's trousers, a safety harness, the safety harness including a support part which is joined to the movable enclosure portion of the pair of firefighter's trousers and which is movable to a desired position to maintain the movable enclosure portion of the pair of the firefighter's trousers in the desired position thereof, and securing means attached to the support part of the safety harness and operable to secure the position of the support part in the desired position thereof and to secure the safety harness upon the firefighter who wears the firefighter'trousers, whereby the securing means is operable to simultaneously secure the safety harness and the pair of firefighter's trousers upon the firefighter who wears the firefighter's trousers.

17. In combination, a firefighter's trousers and safety harness in which the firefighter's trousers including firefighting protective material, complementary connector means, means joining the complementary connector means to the safety harness, the complementary connector means being attachable together to secure the safety harness upon the firefighter who wears the trousers and safety harness combination, the firefighter's trousers including a support region which supports the safety harness, the firefighter's trousers also including closure means for securing the firefighter's trousers upon the firefighter, means joining the complementary connector means to the closure means of the firefighter's trousers, whereby the complementary connector means are attachable together to secure the firefighter's trousers upon the firefighter while simultaneously securing the safety harness upon the firefighter.

18. A firefighter's garment comprising a pair of firefighter's trousers including an outer shell structure of abrasion resistant and flame resistant material and inner liner structure of thermal resistant and moisture resistant material, a safety harness, attachment means for attaching the firefighter's trousers and the safety harness together as a unit, the pair of firefighter's trousers also including a connection portion for securing the firefighter's trousers upon the firefighter who wears the garment, the safety harness including fastener means for securing the safety harness upon the firefighter who wears the garment, and means connecting the fastener means to the connection portion of the firefighter's trousers, whereby the fastener means and the connection portion of the firefighter's trousers are joined together as a single unit and whereby the fastener means is operable to simultaneously secure the safety harness and the firefighter's trousers upon the firefighter who wears the firefighter's garment.

* * * * *

UNITED STATES PATENT AND TRADEMARK OFFICE

CERTIFICATE OF CORRECTION

PATENT NO. : 5,036,548

DATED : August 6, 1991

INVENTOR(S) : William L. Grilliot and Mary I. Grilliot

It is certified that error appears in the above-identified patent and that said Letters Patent is hereby corrected as shown below:

Column 5, line 67, change claim "10" to ---5---.

Column 6, line 16, change claim "10" to ---5---.

Column 6, line 57, insert a comma (,) after "members".

Column 7, line 66, change "including" to ---include---.

Column 8, line 6, change "layer" to ---layers---.

Column 8, line 34, change "including" to ---include---.

Signed and Sealed this

Fifteenth Day of December, 1992

*Attest:*

DOUGLAS B. COMER

*Attesting Officer*

*Acting Commissioner of Patents and Trademarks*